US007230389B2

(12) United States Patent
Takeda et al.

(10) Patent No.: US 7,230,389 B2
(45) Date of Patent: Jun. 12, 2007

(54) METAL HALIDE LAMP HAVING FUNCTION FOR SUPPRESSING ABNORMAL DISCHARGE

(75) Inventors: Kazuo Takeda, Sakai (JP); Isao Ota, Takatsuki (JP); Kazushige Sakamoto, Otsu (JP); Yoshiharu Nishiura, Otsu (JP)

(73) Assignee: Matsushita Electric Industrial Co., Ltd., Osaka-Fu (JP)

( * ) Notice: Subject to any disclaimer, the term of this patent is extended or adjusted under 35 U.S.C. 154(b) by 51 days.

(21) Appl. No.: 10/660,929

(22) Filed: Sep. 12, 2003

(65) Prior Publication Data

US 2004/0104680 A1 Jun. 3, 2004

(30) Foreign Application Priority Data

Sep. 13, 2002 (JP) ..... 2002-267973
Sep. 13, 2002 (JP) ..... 2002-267974
Sep. 19, 2002 (JP) ..... 2002-273700
Sep. 19, 2002 (JP) ..... 2002-273701

(51) Int. Cl.
*H05B 37/02* (2006.01)
*H01J 1/88* (2006.01)

(52) U.S. Cl. ..... 315/209 M; 315/209 CD; 315/49; 315/59; 313/271; 313/276; 313/275; 313/284

(58) Field of Classification Search ..... 315/56–60; 313/25, 27–29, 280–299, 315, 316, 639, 313/641
See application file for complete search history.

(56) References Cited

U.S. PATENT DOCUMENTS

| | | | | |
|---|---|---|---|---|
| 4,179,640 | A * | 12/1979 | Larson et al. | 315/47 |
| 4,344,018 | A * | 8/1982 | Inada | 315/47 |
| 4,520,294 | A * | 5/1985 | Iida et al. | 315/50 |
| 4,897,576 | A | 1/1990 | Iida et al. | |
| 6,054,810 | A | 4/2000 | Yamamoto et al. | 313/607 |
| 6,392,343 | B1 * | 5/2002 | Luijks et al. | 313/570 |
| 2003/0006705 | A1 * | 1/2003 | Alderman et al. | 313/607 |

FOREIGN PATENT DOCUMENTS

| | | |
|---|---|---|
| CN | 1198585 | 11/1998 |
| JP | 56-006366 | 1/1981 |
| JP | 58-030061 | 2/1983 |
| JP | 59-86152 | 5/1984 |
| JP | 08-329892 | 12/1996 |
| JP | 09-213279 | 8/1997 |
| JP | 10-294085 | 11/1998 |
| JP | 2000-294198 | 10/2000 |
| JP | 2004-111064 | 4/2004 |

* cited by examiner

*Primary Examiner*—Tuyet Thi Vo

(57) ABSTRACT

A metal halide lamp includes a ceramic arc tube that is composed of a main body and two narrow tube parts provided at respective ends of the main body; a pair of electrodes provided inside the main body; two feeders, each being connected at one end thereof to a different one of the electrodes inside the main body, and extending through a different one of the narrow tube parts, so as to be external to the arc tube at another end; a starting wire that is connected to one of the feeders, and that is in a vicinity of or contacts an outer surface of the arc tube; and a current suppressing unit that is on a current path of the starting wire, and suppresses or cuts off current on the path.

27 Claims, 11 Drawing Sheets

1071
107b 1071
104a
132
105
131
133
104b
161b 104a
132
105
131
133
104b
107a
107c
107b
107e 5
32
31
33
7a
7
7c
7b
x
y
z

NORMAL STATE
16
16b
7
rd OR GREATER
8b
13
14
16a
8
STARTUP
V0
V1
STEADY STATE
V0 → V1
STARTUP
STEADY STATE

ARC TUBE BREAKAGE
(DISCHARGE DOES NOT OCCUR IN OUTER TUBE)
FUSE CAPACITY Ih
Ih<IL
C PART
rb
IL : LAMP CURRENT DURING NORMAL OPERATION

NORMAL STATE
107
108
113
114
STARTUP
Vo
V1
STEADY STATE
Vo → V1
STARTUP
STEADY STATE

ARC TUBE BREAKAGE
(START OF DISCHARGE IN OUTER TUBE)
ra
rb
C PART
Vo→V1
(CURRENT≒0)

LAST STAGE OF DISCHARGE
IN OUTER TUBE
(END OF DISCHARGE)
CRACK
D PART
rc
V1

METAL HALIDE LAMP HAVING FUNCTION FOR SUPPRESSING ABNORMAL DISCHARGE

BACKGROUND OF THE INVENTION (1) Field of the Invention

The present invention relates to a technique for safer operation of a metal halide lamp.

(2) Description of the Related Art

A conventional metal halide lamp, as shown in FIGS. 10A and 10B, has the following structure. An outer tube 102 is sealed at one end, and a base 112 is attached to the other end. The outer tube 102 accommodates an arc tube 105, stem wires 103*a* and 103*b* that support the arc tube 105, a glass sleeve 110 that encloses the arc tube 105 and acts to protect against explosions, and plates 108 and 109 that hold respective ends of the sleeve 110.

Nitrogen gas is inserted into the outer tube 102 so as to have a pressure of 100 kPa in operation.

A glass stem 101 is welded at the end of the outer tube 102 that is held by the base 112. The stem 101 supports the two stem wires 103*a* and 103*b* that supply current to electrodes.

The arc tube 105 is made up of a cylindrical main tube part that is the central part of the arc tube 105, and two cylindrical, narrow tube parts that are provided on either end of the main tube part. Predetermined amounts of a metal halide, mercury, and a rare gas are sealed in the arc tube 105. The metal halide serves as a light emitting material, the mercury as a buffer, and the rare gas as a starter gas.

A pair of electrodes are provided opposing each other in the main tube part.

An end of each electrode is electrically connected to one end of feeders 104*a* and 104*b*, respectively. The feeders 104*a* and 104*b* are sealed in the narrow tube parts by glass fritting.

The other end of each of the feeders 104*a* and 104*b* extends out of the narrow tube part, and is electrically connected to the stem wires 103*a* and 103*b*, respectively.

In order to light the metal halide lamp, a driving circuit that includes an igniter (not illustrated), a ballast (not illustrated), and a power circuit (not illustrated), is usually provided.

During startup, the igniter adds a high voltage pulse to a sine wave voltage that is applied during steady state, thereby causing weak discharge in the vicinity of a starting wire 107 and an electrode 114. Initial electrons discharged here cause arc discharge at a low starting voltage across the pair of electrodes in the arc tube 105, as shown in FIG. 11A.

In this way, startup performance is improved in a conventional metal halide lamp by inclusion of a starting wire.

However, while able to start with a low voltage, the following problems exist in conventional metal halide lamps.

The inner walls of the arc tube 105 are subject to high temperature and high pressure during discharge. As a result, when the metal halide lamp has been used for a substantial length of time, heat fatigue may cause breakage of the arc tube 105, as shown in FIG. 11B.

When the discharge tube 105 breaks, the rare gas, mercury and metal halide escape. Consequently, arc discharge ceases, and the current value drops to 0.

At this time, the igniter detects that the lamp voltage has risen, and adds a high voltage pulse to the sine wave voltage, in the same manner as at startup.

This causes breakage of insulation between one of the electrodes and the part of the starting wire 107 whose distance ($r_b$) from the electrode is shorter than the distance ($r_a$) between the electrodes, and subsequently causes arc discharge, in other words abnormal discharge across the electrode and the starting wire 107.

Note that this abnormal discharge is also called outer tube discharge.

The starting wire 107 is made of a narrow molybdenum wire, or the like, and therefore when abnormal discharge occurs, a C part where the discharge starts (shown in FIG. 11B) melts. However, abnormal discharge continues because a portion of the starting wire that is above the melted C part is connected to the electrode 113.

Melting consequently progresses, and, as shown in FIG. 11C, while the portion of the starting wire above the C part continues to melt, the discharge distance ($r_c$) increases, extending to a D part.

As the discharge distance reaches the discharge distance ($r_c$), the voltage necessary to continue abnormal discharge can no longer be provided, and the abnormal discharge ceases.

During the progression to this point, breakage of the ballast and the like often occurs due to the large current that accompanies the abnormal discharge. Furthermore, there is also a possibility of cracking and breakage of the outer tube 102 as a result of the temperature increase caused by the abnormal discharge.

SUMMARY OF THE INVENTION

In view of the stated problems, a first object of the present invention is to provide a metal halide lamp that is resistant to secondary damage caused by abnormal discharge, even when the arc tube breaks.

Furthermore, a second object is to provide a manufacturing method for a high pressure lamp that achieves the first object.

In order to achieve stated first object, the present invention is characterized as follows.

(1) A metal halide lamp, including: a ceramic arc tube that is composed of a main body and two narrow tube parts provided at respective ends of the main body; a pair of electrodes provided inside the main body; two feeders, each being connected at one end thereof to a different one of the electrodes inside the main body, and extending through a different one of the narrow tube parts, so as to be external to the arc tube at another end; a starting wire that is connected to one of the feeders, and that is in a vicinity of or contacts an outer surface of the arc tube; and a current suppressing unit that is on a current path of the starting wire, and suppresses or cuts off current on the path.

When abnormal discharge occurs, secondary damage caused by the abnormal discharge is reduced by the functioning of the current suppressing unit.

(2) Furthermore, in the metal halide lamp of (1), the current suppressing unit may be a circuit breaking element.

According to the stated structure, by suppressing current, abnormal discharge is prevented, and therefore secondary damage caused by abnormal discharge is also prevented.

(3) Furthermore, in the metal halide lamp of (2), the circuit breaking element may be a resistor.

According to the stated structure, the amount of current that flows through the circuit breaking element is reduced, and therefore abnormal discharge is reduced.

(4) Furthermore, in the metal halide lamp of (3), it is preferable that a resistance value of the resistor is in a range of 1 kΩ to 1 MΩ, inclusive.

According to the stated structure, the amount of current that flows through the circuit breaking element is restricted to a range in which the starting voltage does not rise. Therefore, startup performance is maintained, while abnormal discharge is suppressed.

(5) Furthermore, in the metal halide lamp of (4), it is preferable that the metal halide lamp has a power rating in a range of 50 W to 400 W, inclusive, wherein two terminals that each connect to a power supply path are provided at two different positions on the circuit breaking element, a distance between the terminals being at least 4.5 mm.

According to the stated structure, abnormal discharge across the terminals of the current limiting device is suppressed.

(6) Furthermore, in the metal halide lamp of (5), it is preferable that the arc tube is accommodated in an outer tube, a sleeve that encloses at least the main body is provided between the outer tube and the arc tube, a first supporting part and a second supporting part are provided at respective ends of the sleeve in order to hold the sleeve, and the circuit breaking element is provided in the outer tube, in a space that is outside a space between the first supporting part and second supporting part.

According to the stated structure, thermal conductivity that is caused by radiant heat and convection that accompany discharge in the arc tube is stopped by the first support member or the second support member. Therefore, thermal load on the circuit breaking element is lightened.

In other words, deterioration of the circuit breaking element according to heat is reduced.

(7) Furthermore, in the metal halide lamp of (6), the first supporting part is joined to the feeder to which the starting wire is connected, and has an aperture through which the starting wire passes, and a minimum distance between the first supporting part and a part of the starting wire that passes through the aperture is at least 4.5 mm.

According to the stated structure, abnormal discharge is prevented on a discharge path between the first supporting part and the part of the starting wire that passes through the aperture.

(8) Furthermore, in the metal halide lamp of (7), one end of the starting wire may be wound around a part of the arc tube that is resistant to deformation if the arc tube breaks.

According to the stated structure, the gap between the starting wire and the second electrode remains relatively constant when the arc tube breaks.

In other words, since the discharge distance influences the discharge state of abnormal discharge, deviation can be reduced between design parameters that take suppression of abnormal discharge into consideration and realistic design parameters, and abnormal discharge can be suppressed more realistically.

(9) Furthermore, in the metal halide lamp of (2), the circuit breaking element may be a capacitor.

According to the stated structure, when the metal halide lamp is driven by alternating current, the amount of current that flows through the circuit breaking element can be restricted. Therefore, abnormal discharge is suppressed.

(10) Furthermore, in the metal halide lamp of (1), the current suppressing unit may be a circuit breaking element that cuts current to the starting wire within a predetermined amount of time of abnormal discharge commencing.

According to the stated structure, abnormal discharge is stopped, and secondary damage by the abnormal discharge is prevented.

(11) Here, it is preferable that the predetermined amount of time is 10 seconds.

In other words, breakage of the ballast, the outer tube, and so on does not occur if discharge lasts for no longer than 10 seconds. Therefore, secondary damage to these components is prevented.

(12) Furthermore, by cutting the current within one second of the abnormal discharge occurring, secondary damage by the abnormal discharge can be prevented even more reliably.

(13) Furthermore, in the metal halide lamp of (12), the circuit breaking element may be a fuse whose current capacity is equal to or less than a value of current required for ordinary operation of the metal halide lamp.

According to the stated structure, secondary damage by abnormal discharge can be prevented inexpensively.

(14) Furthermore, in the metal halide lamp of (13), it is preferable that two terminals that connect to a power supply path are provided at two different positions on the circuit breaking element, a distance between the terminals being at least 4.5 mm.

According to the stated structure, abnormal discharge is prevented across the terminals of the circuit breaking element.

(15) Furthermore, in the metal halide lamp of (14), the fuse may be the starting wire.

According to the stated structure, secondary damage according to abnormal discharge can be prevented without necessity for a complicated structure.

(16) Furthermore, in the metal halide lamp of (15), it is preferable that when abnormal discharge occurs, the starting wire melts, within the predetermined amount of time, to an extent that a discharge distance is insufficient for abnormal discharge to continue.

According to the stated structure, abnormal discharge ends within a short period of time that is insufficient for secondary damage to occur. Therefore, secondary damage is prevented.

(17) Furthermore, in the metal halide lamp of (16), the starting wire may be made of a metal selected from the group consisting of molybdenum, tungsten, niobium, and-iron, or of an alloy that contains a metal selected from the group.

According to the stated structure, freedom of design of the starting wire that includes the circuit breaking element is increased.

(18) Furthermore, in the metal halide lamp of (17), it is preferable that the starting wire is a molybdenum wire that has a diameter of 0.2 mm or less.

According to the stated structure, the starting wire melts in a short period of time even if abnormal discharge occurs.

(19) Furthermore, in the metal halide lamp of (18), it is preferable that the arc tube is accommodated in an outer tube, a sleeve that encloses at least the main body is provided between the outer tube and the arc tube, a first supporting part and a second supporting part are provided at respective ends of the sleeve in order to hold the sleeve, and the circuit breaking element is provided in the outer tube, in a space that is outside a space between the first supporting part and second supporting part.

According to the stated structure, thermal conductivity that is caused by radiant heat and convection that accompany discharge in the arc tube is stopped by the first supporting part or the second supporting part. Therefore, thermal load on the circuit breaking element is lightened.

In other words, deterioration of the circuit breaking element according to heat is reduced.

(20) Furthermore, in the metal halide lamp of (19), it is preferable that the first supporting part is joined to the feeder to which the starting wire is connected, and has an aperture through which the starting wire passes, and a minimum distance between the first supporting part and a part of the starting wire that passes through the aperture is at least 4.5 mm.

(21) Furthermore, in the metal halide lamp of (19), it is preferable that one end of the starting wire is wound around a part of the arc tube that is resistant to deformation if the arc tube breaks.

According to the stated structure, the gap between the starting wire and the second electrode remains relatively constant when the arc tube breaks.

(22) Furthermore, the metal halide lamp of (2) may further include a sleeve that encloses the arc tube; and a supporting part that supports the sleeve at at least one end of the sleeve, and is conductive, wherein the starting wire passes through the supporting part in a state of insulation from the supporting part.

According to the stated structure, even when the routing path of the starting wire is near the supporting part that has different electric potential, discharge across the starting wire and the supporting part is prevented.

Note that here insulation refers to that provided so that discharge does not occur across the starting wire and the supporting part even when the outer envelope of the arc tube breaks, and does not refer only to insulation for normal lamp operation.

(23) Furthermore, in the metal halide lamp of (22), it is preferable that the starting wire passes through insulation provided on the supporting part, the insulation lying between the starting wire and the supporting part.

Ordinarily, current is suppressed by the circuit breaking element dropping the voltage. Furthermore, ordinarily, the supporting part through which the downstream path of the circuit breaking element passes has the same electric potential as upstream of the circuit breaking element.

Consequently, although there is a possibility that discharge will occur across the downstream path of the circuit breaking element and the supporting part, the stated structure prevents this discharge.

(24) Furthermore, in the metal halide lamp of (23), a slant distance between the starting wire and one of the electrodes that is not the electrode connected to the starting wire via the one of the feeders, is shorter than a distance between the electrodes.

According to the stated structure, startup performance of the metal halide lamp is improved.

Furthermore, in order to achieve the stated second object, the metal halide lamp manufacturing process of the present invention is characterized as follows.

(25) A metal halide lamp manufacturing method including: a starting wire formation step of forming a starting wire by applying a bending process to a wire so as to bend the wire into a shape that corresponds to a shape of an arc tube; a fitting step of fitting the formed starting wire around an outer surface of the arc tube; a connecting step of connecting the starting wire to a mechanism that is present in the metal halide lamp and that suppresses or cuts off current.

According to the stated structure, if the starting wire is first formed in advance and then fitted, opportunities for the starting wire to deform are reduced, and insulation faults due to the starting wire deviating from the intended routing path are reduced.

Furthermore, in this manufacturing method, in the step in which the bending process is executed, the wire is bent to correspond to the shape of the arc tube, and in the fitting step, the starting wire is fitted so as to traverse the outside of the arc tube. Therefore, compared to conventional methods in which the bending process is performed while fitting the wire to the outside of the arc tube, the stated manufacturing method improves work efficiency.

(26) The arc tube is composed of a main body part and two narrow tube parts that extend from respective ends of the main body, and in the starting wire forming step, at least two parts of the wire are formed into fitting parts, each for fitting to a different one of the narrow tube parts by winding therearound with less than one turn.

According to the stated structure, when the fitting parts are fitted to the narrow tube parts, the narrow tube parts can be easily inserted from the parts that have not been wound. Therefore, workability is improved.

(27) Respective axes of the narrow tube parts are on substantially a same straight line, and when the starter conductor is in a free state, respective axes of the fitting parts are mutually offset.

According to the stated structure, since the starting wire is always energized due to restorative power when fitted to the arc tube, the starting wire fits tightly to the arc tube.

(28) The wire includes at least one element selected from the group consisting of molybdenum, tungsten, niobium, and iron.

Wires containing these elements are in general distribution, and therefore elemental wires thereof are readily obtainable.

BRIEF DESCRIPTION OF THE DRAWINGS

These and other objects, advantages and features of the invention will become apparent from the following description thereof taken in conjunction with the accompanying drawings which illustrate a specific embodiment of the invention.

In the drawings.

DESCRIPTION OF THE PREFERRED EMBODIMENTS

First Embodiment

<Structure>

Figure 1B:
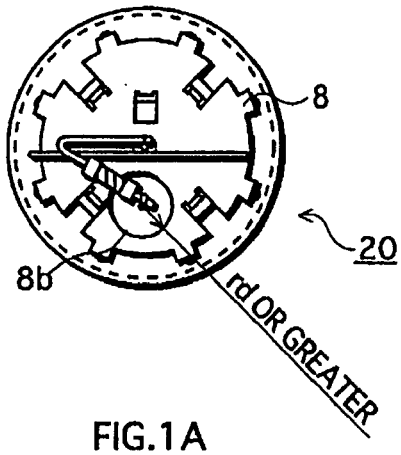
FIGS. 1A and 1B are schematic drawings of a metal halide lamp of a first embodiment of the present invention.
Figure 1A:
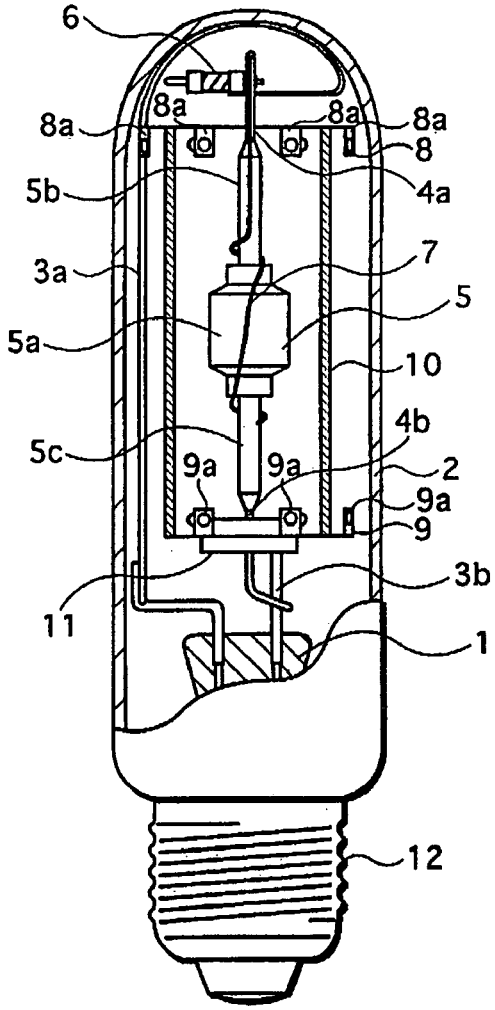

FIGS. 1A and 1B are schematic diagrams of a metal halide lamp 20 in an embodiment of the present invention.

The metal halide lamp 20 is a high intensity discharge lamp that has a power rating of 150 W. As shown in FIG. 1A, the metal halide lamp 20 has a stem 1, an outer tube 2, stem wires 3*a* and 3*b*, feeders 4*a* and 4*b*, an arc tube 5, a circuit breaking element 6, a starting wire 7, plates 8 and 9, a sleeve 10, insulation 11, and a base 12.

The stem 1 is a glass member that supports the stem wires 3*a* and 3*b*.

The outer tube 2 is made of hard glass, or the like, and a non-volatile gas such as nitrogen is sealed in the outer tube 2 so as to have a pressure of 100 kPa in operation (approximately 300° C.).

The base 12 is a bipolar terminal for connecting the metal halide lamp 20 to a lighting socket.

The stem wire 3*a* is connected at one end to one of the electrode terminals (not illustrated) in the base 12, and passes through the stem 1 to be welded at the other end to the feeder 4*a*.

The stem wire 3*b* is connected at one end to the other electrode terminal (not illustrated) in the base 12, and passes through the stem 1 to be welded at the other end to the feeder 4*b*.

The arc tube 5 is made from a transparent ceramic material such as alumina (thermal expansion coefficient $8.1*10^{-6}$), and is composed of a cylindrical main tube part 5*a*, and cylindrical narrow tube parts 5*b* and 5*c* that are narrow in diameter and are provided at respective ends of the main tube part 5*a*.

A predetermined metal halide, mercury, and rare gas, such as neon or argon, are sealed in the discharge space of the main tube part 5*a*, at a pressure of 13 kPa at room temperature. Furthermore, a pair of electrodes (electrodes 13 and 14) are arranged opposing each other in the main tube part 5*a* (see FIG. 3).

After having been connected to the feeder 4*a* and 4*b*, respectively, the electrode 13 and 14 are inserted into the respective narrow tube parts, and sealed with a sealing member.

The sleeve 10 is made from quartz that is formed into a cylindrical shape, and prevents fragments of the arc tube 5 from scattering and damaging the outer tube 2 when the arc tube 5 breaks.

The plates 8 and 9 are thin stainless steel plates, and hold the sleeve 10 so that there is a set gap between the sleeve 10 and the arc tube 5.

Furthermore, the feeders 4*a* and 4*b* pass through the plates 8 and 9, respectively, and the plates 8 and 9 have a plurality of claw parts 8*a* and 9*a*, respectively, on the outer periphery that contact the inner wall of the outer tube 2.

Here, since the rod-shaped feeders 4*a* and 4*b* are inserted into the arc tube 5 along the center longitudinal axis of the arc tube 5, by guiding the feeders 4*a* and 4*b* substantially along the center axis of the outer tube 2, the plates 8 and 9 guide the center axis of the arc tube 5 substantially along the center axis of the outer tube 2.

Furthermore, the inside of the outer tube 2 is separated into three areas by the plates 8 and 9. Specifically, the three areas are a central part in which the arc tube 5 is positioned, and ends parts at either end of the central part.

Since the arc tube 5, which is the light source, is in the central part, the plates 8 and 9 in the end parts block the light, in other words the radiant heat, from the arc tube 5.

For this reason, the temperature at either end in operation is lower than that in the central part of the arc tube 5.

Furthermore, an aperture 8*b*, through which the starting wire 7 passes, is provided in the plate 8, as shown in FIG. 1B.

The insulation 11 is an insulative member that is inserted between the plate 9 and the feeder 4*b* to float the electric potential of the plate 9.

The starting wire 7 is a molybdenum wire that has a diameter of 0.2 mm. The starting wire 7 is welded to the circuit breaking element 6 at one end, wound around the narrow tube part 5*b*, touches the periphery of the main tube part 5*a* in a central part, and wound around the narrow tube part 5*c* in a vicinity of the electrode 14 at the other end.

Note that because the feeders 4*a* and 4*b* are inserted in the narrow tube parts 5*b* and 5*c*, respectively, the narrow tubes 5*a* and 5*b* are resistant to deformation, even when breakage occurs. Consequently, the starter wire 7 wound around the narrow tube parts 5*b* and 5*c* does not move easily.

The circuit breaking element 6 is a carbon-film resistor that has a resistance value ($R_G$) of 20 kΩ. One end of the circuit breaking element 6 is connected to the feeder 4*a* and the other end is connected to the starting wire 7.

Figure 3A:
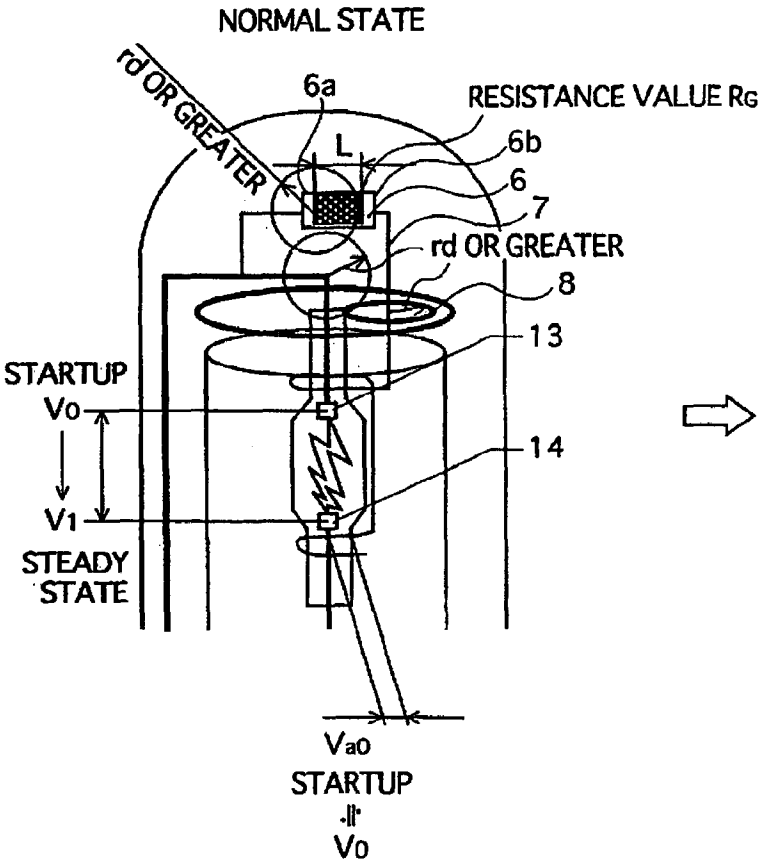
FIGS. 3A and 3B are type drawings showing states of operation of the metal halide lamp of the first embodiment during normal operation and when a main tube part breaks.

The circuit breaking element 6 is capped at each end by cap terminals 6*a* and 6*b*, respectively, as shown in FIG. 3A. A gap (L) of 4.5 mm is provided between the cap terminals 6*a* and 6*b*, for the following reason.

If the insulation between the starting wire 7 and the electrode 14 breaks, a large difference in electric potential occurs between the cap terminal 6*a* and 6*b* of the circuit breaking element 6. However, it is assumed that if the circuit breaking element 6 is made to function normally as a resistor, insulation breakage due to electric potential difference will not occur between the cap terminals 6*a* and 6*b*.

In order to prevent insulation breakage between the cap terminals 6*a* and 6*b*, it is necessary to ensure a set insulation distance (rd) between the cap elements 6*a* and 6*b*.

As a result of experimenting, the inventors found that an insulation distance (rd) of 4.5 mm is appropriate in metal halide lamps having a power rating in a range of 50 W to 400 W, including the metal halide lamp 20 (power rating 150 W).

As shown in FIG. 1B, an aperture of 8*b* through which the starting wire 7 passes is provided in the plate 8. For the reasons described above, the diameter of this aperture is such that the insulation distance from the starting wire is at least the described insulation distance (rd), in other words, at least 4.5 mm.

Provided as a driving circuit to drive the metal halide lamp 20 are a power circuit (not illustrated) that supplies power, a ballast (not illustrated) for adjusting the lamp voltage and the lamp current, and an igniter for applying a high voltage pulse during startup.

Figure 2A:
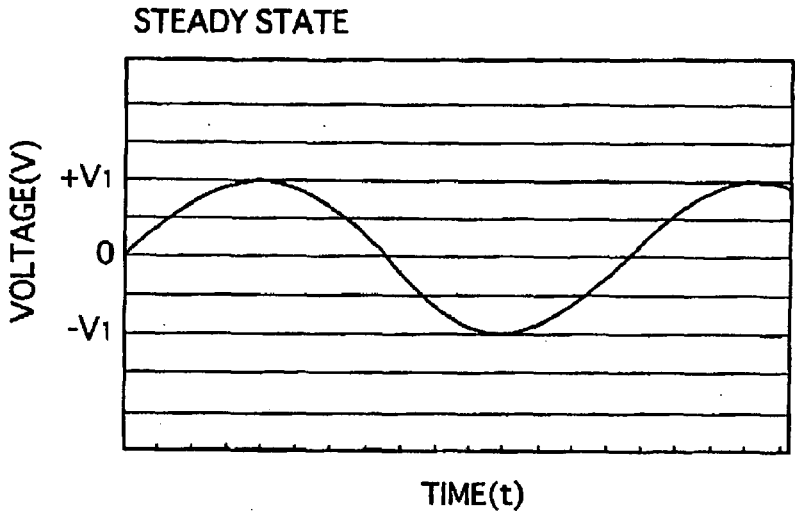
FIGS. 2A and 2B show the waveform of voltage applied across two electrodes in an arc tube.

After being switched on, the power circuit generates a sine wave voltage that has a frequency of 60 Hz and a peak voltage of 325V ($+V_1$, $-V_1$), as shown in FIG. 2A.

Figure 2B:
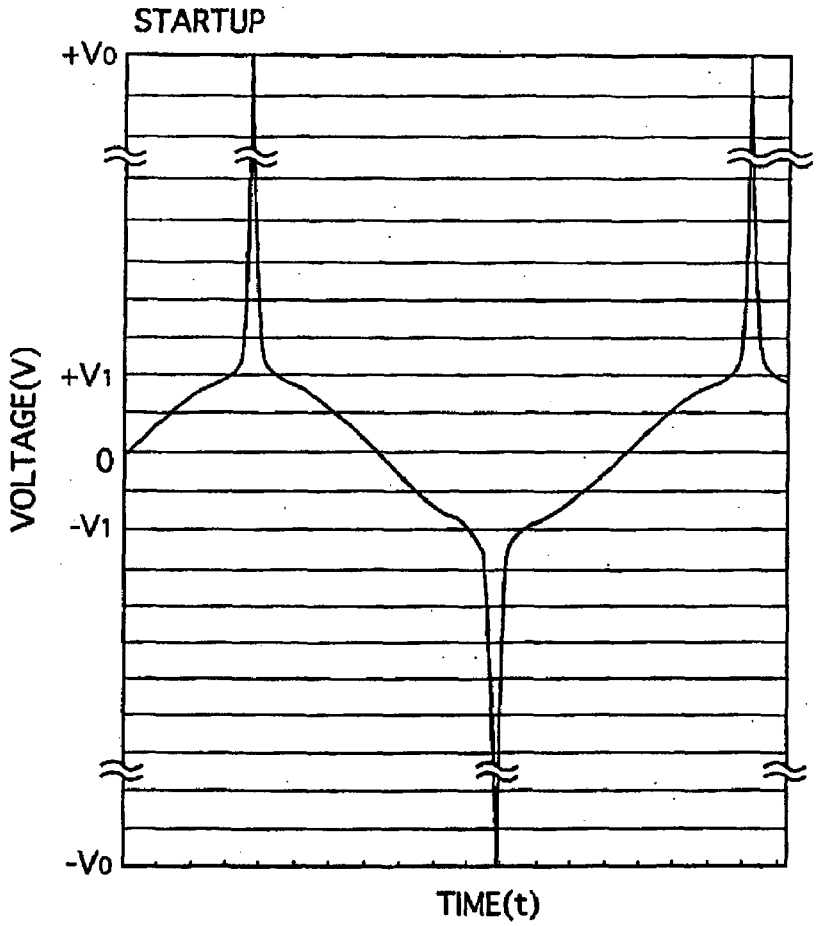

The igniter is a circuit that operates on detecting that the lamp voltage is high. As shown in FIG. 2B, when the lamp voltage is around the sine wave peak point, the igniter adds a high voltage pulse to increase the peak voltage to 4500 V ($+V_0$, $-V_0$).

On startup, arc discharge does not occur across the electrodes 13 and 14 in the light emission tune 5, but when the high pressure pulse is added, weak discharge occurs around the starting wire 7 and the electrode 14, thereby generating initial electrons that cause arc discharge across the electrodes.

<Operations>

FIG. 3A shows the state of the metal halide lamp 20 during normal operation.

During startup, before arc discharge occurs across the electrodes 13 and 14, a 4500 V high voltage pulse ($+V_0$, $-V_0$) is applied across the electrodes 13 and 14, but because very few electrons that contribute to discharge exist in the main tube part 5*a,* arc discharge does not occur across the electrodes 13 and 14.

On the other hand, when the high voltage pulse ($+V_0$, $-V_0$) is applied across the starting wire 7 and the electrode 14, despite being spatially isolated from each other by the ceramic fine tube part 5*b,* weak discharge occurs in the vicinity of the electrode 14 due to an increase in the electric potential gradient between the end of starting wire 7 and the electrode 14.

During weak discharge, the value of the current is extremely low, due to the above-described mechanism.

Strictly speaking, a voltage drop occurs because the circuit breaking element 6 has a resistance value of 20 kΩ. However, since the current is extremely low, the voltage drop is also extremely low.

Consequently, there is little difference between the voltage ($+V_{a0}$, $-V_{a0}$) that is applied to the end of the starting wire 7 and the above-described high voltage pulse ($+V_0$, $-V_0$).

In other words, the circuit breaking element 6 has minimal influence on the value of the high voltage pulse.

For this reason, regardless of whether the circuit breaking element 6 is present or not, weak discharge occurs across the electrode 14 and the starting wire 7 on startup, due to the 4500 V high voltage pulse ($+V_0$, $-V_0$) added by the igniter. The weak discharge causes initial electrons that cause arc discharge across the electrodes 13 and 14.

Of course, the resistance value of the circuit breaking element 6 cannot be ignored if it is high.

Since the voltage applied across the electrode 14 and the end of the starting wire 7 near the electrode 14, decreases, the weak discharge ceases. Consequently, arc discharge initial electrons stop being generated, and the starting voltage rises.

The resistance value of the circuit breaking element 6 is a value within a range in which the starting voltage does not rise, and was found by experiment. The inventors found that the resistance value is not limited to the described 20 kΩ, but may be any value within a range that is no more than the maximum resistance value (R2) that clears a criterion in startup performance evaluation for achieving problem-free startup, in other words, no more than 1 MΩ.

<Breakage of the Main Tube Part 5*a*>

The following describes breakage of the main tube part 5*a*.

Figure 3B:
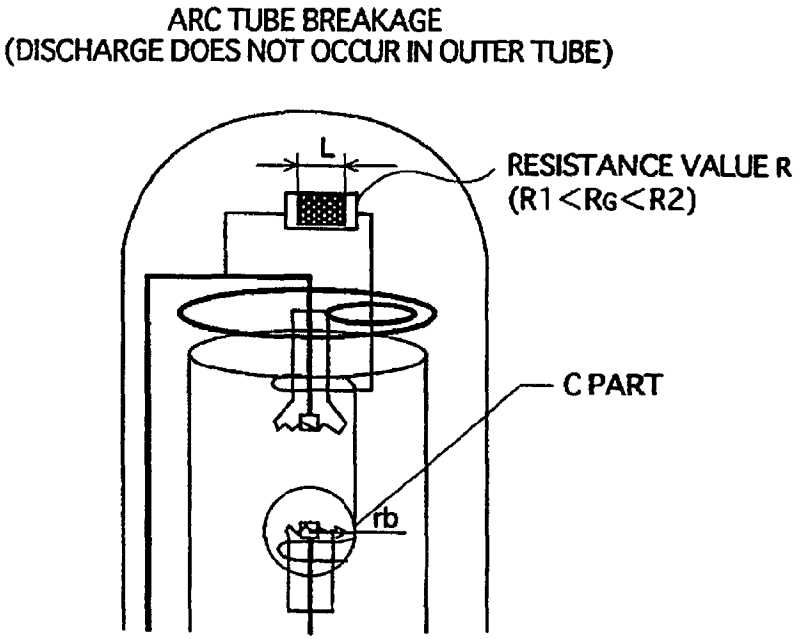

FIG. 3B shows the state of operation of the metal halide lamp 20 when the main tube part 20 breaks.

During operation the main tube part 5*a* becomes a small pressure vessel that is subject internally to high temperature and high pressure, and may break due to cracks and the like caused by heat fatigue.

When breakage occurs, the metal halide, mercury, and rare gas such as neon or argon, leak from the arc tube 5 to the outer tube 2.

Then, when the main tube part 5*a* that acts as insulation between the neighboring parts of the starting wire 7 and the electrode 14 is damaged and falls away, the starting wire 7 and the electrode 14, between which there is an electric potential difference, are exposed to each other.

At this time, arc discharge across the electrodes 13 and 14 ceases due to the breakage of the main tube part 5*a,* and the lamp voltage rises. The igniter detects the increase in lamp voltage, and adds a high voltage pulse ($+V_0$, $-V_0$) to the since wave voltage.

As a result, a 4500 V high voltage pulse is applied across the electrodes 13 and 14.

This causes destruction of insulation between the part of the starting wire 7 that is closest to the electrode 14, specifically the C part, and the electrode 14.

Here, discharge occurs only at the instant that the high voltage pulse is applied. Hereinafter, this discharge is referred to as "pulse discharge".

During pulse discharge, the current value is low, therefore no effect is obtained from the circuit breaking element 6.

On the other hand, the high voltage pulse continues to be applied during pulse discharge, and therefore develops into arc discharge in which a greater current flows.

However, the current that flows through the starting wire 7 is restricted by the circuit breaking element 6 so as to be less than the current value necessary for arc discharge, and therefore arc discharge does not occur.

The inventors confirmed that in order to restrict the current sufficiently to prevent arc discharge in the metal halide lamp 20 (power rating 150 W), it is necessary for the resistance value R1 to be at least 1 kΩ.

Consequently, the range resistance value of the circuit breaking element 6 necessary to prevent abnormal discharge when the main tube part 5*a* breaks, and to maintain startup performance, is a range of 1 kΩ to 1 MΩ.

<Method of Fitting the Starting Wire>

As described earlier, it is necessary to provide an insulation distance (rd) or greater between the plate 8 and the starting wire 7. However, since variations in product precision present difficulties in providing the insulation distance (rd) when a conventional method is used for fitting the starting wire, the method for fitting the starting wire was reviewed.

<Conventional Method for Fitting the Starting Wire>

Figures 4A, 4B, 4C:
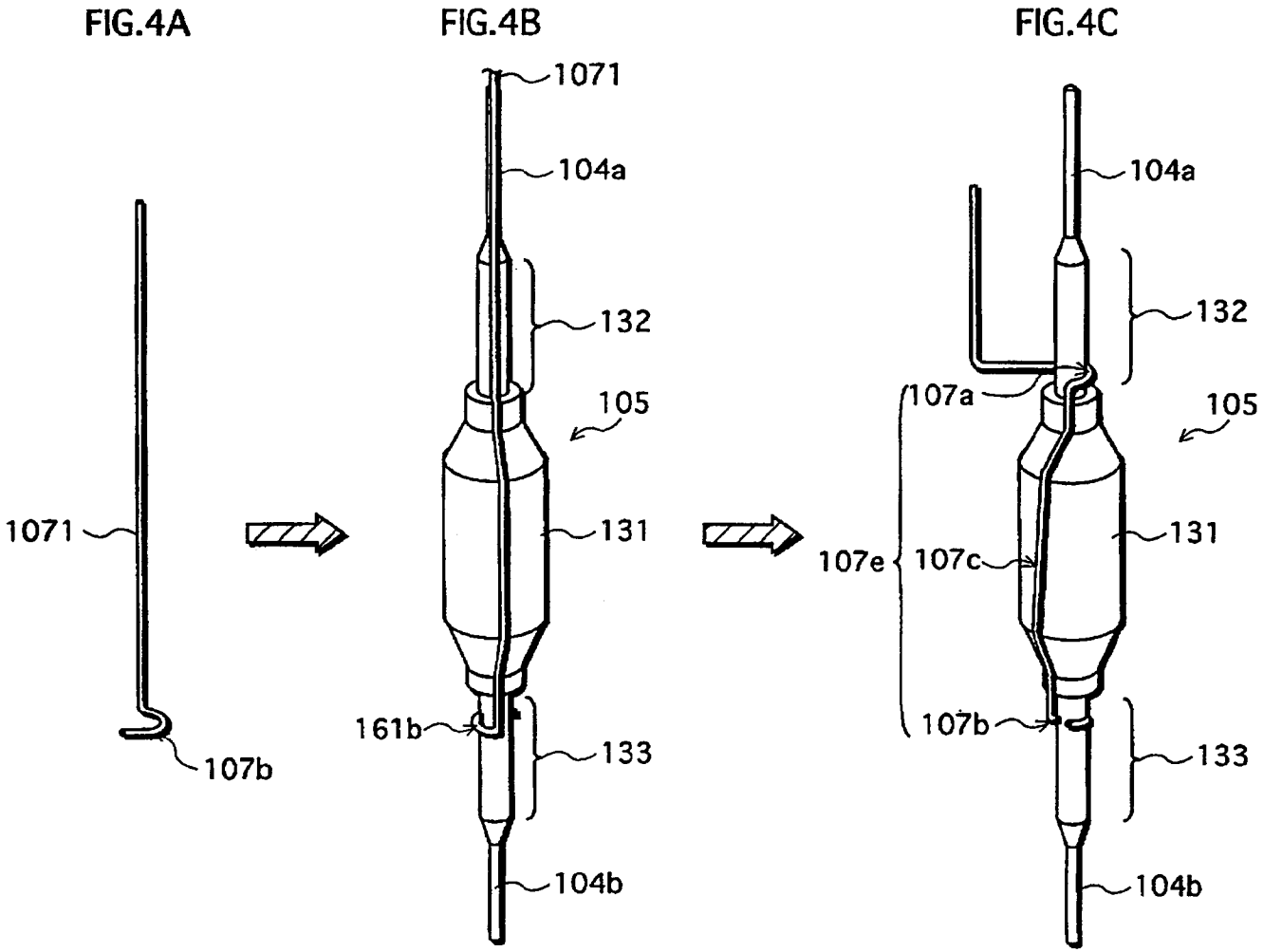
FIGS. 4A to 4C are process drawings showing a process for fitting a starting wire to an arc tube in a conventional manufacturing method.

A conventional starting wire fitting method, as shown in FIG. 4, consists of first providing a straight metal wire 1071, then bending the metal wire 1071 so that the lower end part is orthogonal to a longitudinal direction of the metal wire 1071, and then winding the lower part a half to three quarter turn. Here, the inner circumference of the turn is the same as or slightly greater than the outer circumference of the narrow tube part 133 of the arc tube 105 (see FIG. 4B). A fitting part 107*b,* as shown in FIG. 4A, is formed in the lower part as a result of this process.

Next, the fitting part 107*b* is fitted to the thin tube part 133 of the arc tube, the metal wire 1071 thereby being attached to the arc tube 105. The metal tube 1071 is then bent to conform to the periphery of the main tube part 131 of the arc tube 105 (FIG. 4B).

Finally, the metal wire 1701 is bent (a half to three quarter turn) to fit the periphery of the narrow tube part 132 on the upper side of the arc tube 105. This winding process results in fitting parts 107*a* and 107*b* being fitted to the narrow tube parts 132 and 133 at either end of the arc tube 105, and a portion 107*e* being formed to conform to the periphery of the main tube part 131. This completes the procedure for fitting the starting wire 107 (FIG. 4C).

However, when the described method is used to fit the starting wire, and the arc tube 105 is stored or transported with the starting wire 107 fitted thereon, the upper part of the starting wire is subject to external force that causes deformities, because it is in a position detached from the arc tube 105.

Since this upper part is the part that is inserted in the aperture 8*b*, if a deformity occurs, instead of passing through the center of the aperture 8*b* as intended, the position of the part deviates from the intended position. This means that the distance between the part and the plate 8 is narrower than intended.

Furthermore, the starting wire 107 cannot be fitted until after the arc tube 105 has been fabricated, and therefore the fabrication process for the arc tube 105 and the fitting process for fitting the starting wire 107 to the arc tube 105 must be performed in series. This is undesirable in terms of work efficiency.

<Method for Fitting the Starting Wire in the First Embodiment>

In contrast to the conventional method, the following method for fitting the starting wire is employed in the first embodiment to reduce the described problems.

Figures 5A, 5B:
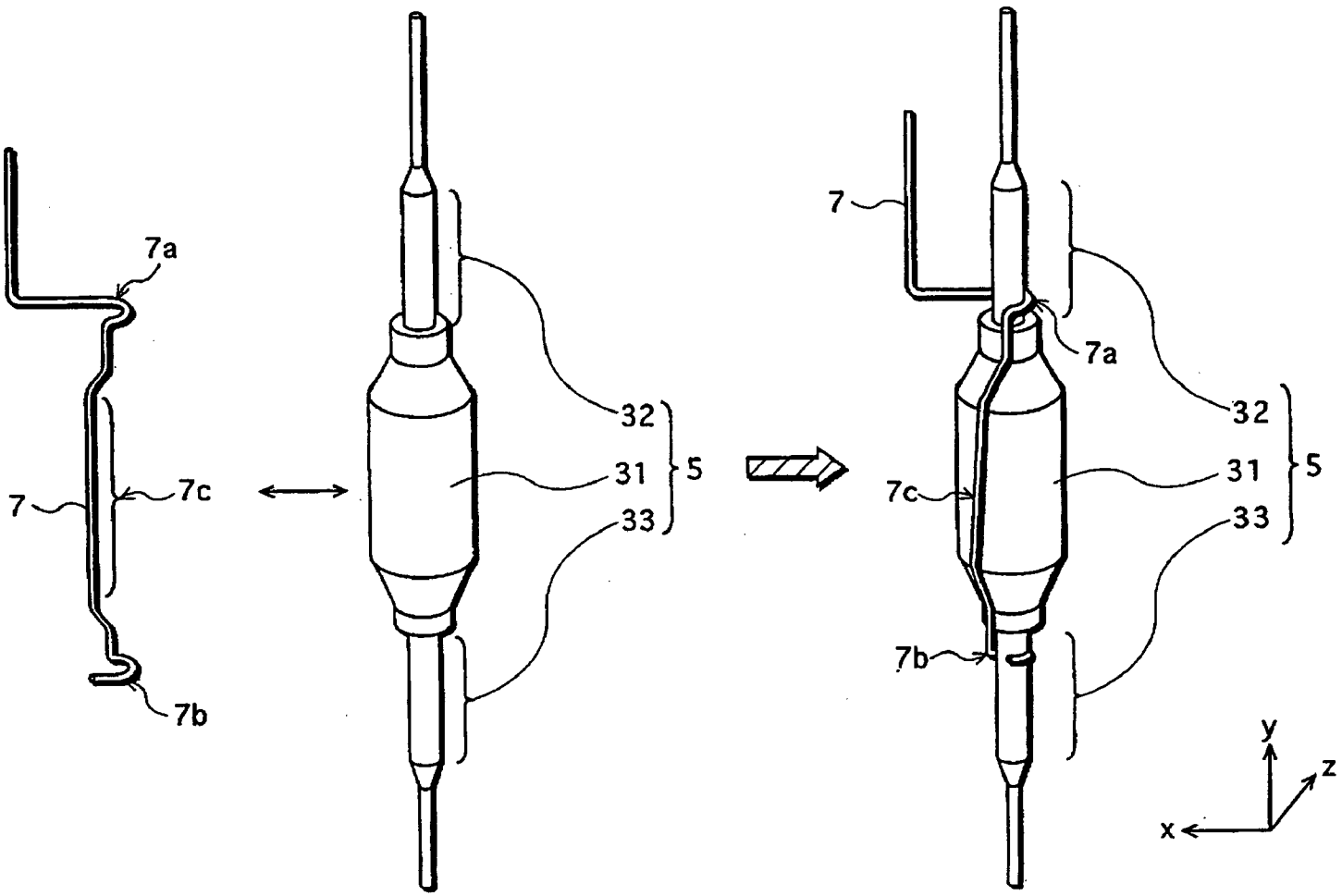
FIGS. 5A and 5B are process drawings showing a process for fitting a starting wire to the arc tube in the manufacturing process for the metal halide lamp of the first embodiment of the present invention.

The following describes, with use of FIGS. 5A and 5B, the method for fitting the starting wire 7 to the arc tube 5, in the manufacturing method of the first embodiment.

As shown in FIG. 5A, in the manufacturing method for the metal halide lamp of the present embodiment, the starting wire 7 is bent to conform to the external shape of the arc tube 5, before being fitted to the arc tube 5.

Specifically, a molybdenum wire with a 0.2 mm diameter is bent at a substantially 90° angle with respect to the longitudinal direction of the wire. Next, the bent wire is wound approximately a half turn (i.e. bent approximately 180°) at a point that is a set distance from the 90° bend (the distance is determined according to the external shape of the arc tube 5 to which the wire is to be fitted), thereby forming the fitting part 7*a*. The inner diameter of the turn is equal to or slightly greater than the outer diameter of the narrow tube part 5*b* of the light emitting tube 5.

The tip portion of the fitting part 7*a* is again bent 90°, and then pointed in the downwards direction of FIG. 5A. Next, the wire is worked into a shape that is substantially a squared C-shape. The portion 7*c*, which is a vertical straight line in the squared C-shape, is the portion that fits along the outer side of the wall of the main tube part 5*a* when fitted to the light emitting tube 5.

After making the squared C-shape, the portion 7*c* is again pointed in the downwards direction.

After being bent approximately 90°, the end of the wire is wound a half turn (approximately 180°), thereby forming the fitting part 7*b*. This completes the starting wire 7.

Note that the respective central winding axes of the fitting parts 7*a* and 7*b* are set so as to have a set interval therebetween in the z axis direction in the coordinate system in FIGS. 5A and 5B. This is described in more detail later.

Furthermore, it is preferable that the fitting part 7*a* and the fitting part 7*b* are wound for less than one turn so that use can be made of the spring of the wire.

However, it is also preferable that the wire is wound at least half a turn when forming each of the fitting parts 7*a* and 7*b*, so that the starting wire 7 does not dislodge from the arc tube 5 once fitted.

As shown in FIG. 5B, the starting wire 7 that has been formed by the bending process, is fitted to the arc tube 5 to conform to the outer shape of the arc tube 5.

Fitting of the starting wire 7 to the arc tube 5 can be performed without bending or the like at this point, by simply latching the fitting part 7*b* to the narrow tube part 5*c* around the lower part of the arc tube 5, and latching the fitting part 7*a* to the narrow tube part 5*b* around the upper part of the arc tube 5.

Since the fitting parts 7*a* and 7*b* are formed with the on mutually different central winding axes in the bending procedure, the spring of the fitting parts 7*a* and 7*b* attempting to return to their original (free) state prevents the starting wire 7 from easily dislodging from the arc tube 5 once fitted.

Another reason for this spring effect is that the starting wire 7 is attached to the arc tube 5 so that the straight portion 7*c* of the starting wire 7 is at an angle in relation to the axis of the arc tube 5.

Figure 6:
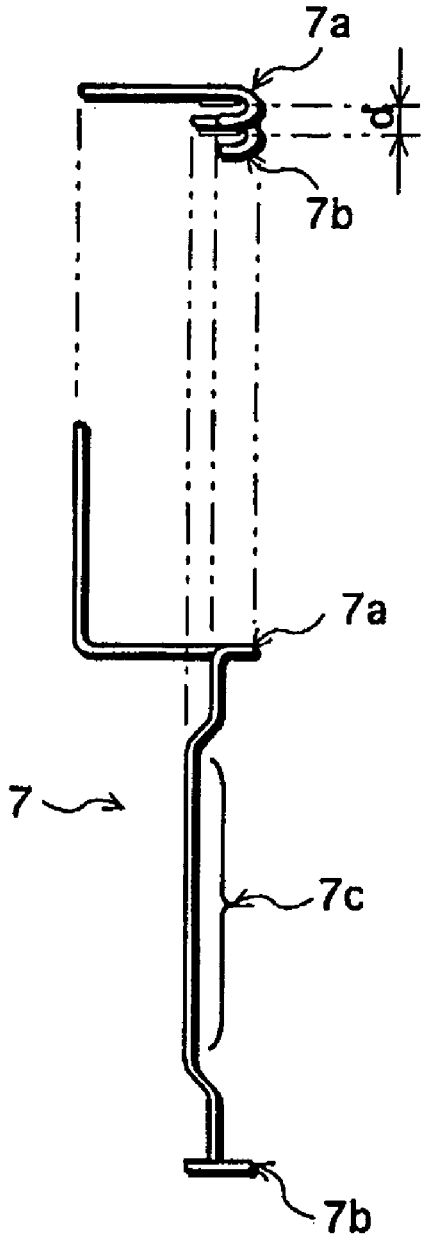
FIG. 6 shows a side view and a top view of the starting wire before being fitted to the arc tube of the first embodiment of the present invention.

The form of the starting wire 7 after the bending process is described with use of FIG. 6. FIG. 6 shows a side view and a top view of the starting wire 7 after the bending process.

As shown in the side view in FIG. 6, the bent starter wire 7 is shaped so as to conform to the outer form of the arc tube to which the starter wire is to be fitted.

However, as has been described, the fitting part 7*a* that is fitted to the narrow tube part 5*b* and the fitting part 7*b* that is fitted to the narrow tube part 5*c* are offset a distance d when the starting wire 7 is in a free state, as shown in the top view.

In other words, the offset distance d gives the starting wire 7 spring when fitted to the arc tube 5, and serves to prevent the starting wire 7 from disengaging easily from the arc tube 5.

When the inner diameter of the turns of the fitting parts 7*a* and 7*b* is 3 mm, it is preferable that the distance d is a substantially equivalent 3 mm. However, it should be noted that it may be necessary to find optimum value depending on the diameter and mechanical characteristics of the material used for the starting wire 7.

Furthermore, a straight portion (the portion that contacts the main tube part 5*a* of the arc tube 5) 7*c* of the bent starting wire 7 is maintained in a vertical direction, as shown in FIG. 6. The straight portion 7*c* is at an angle in relation to the axis of the arc tube 5, as shown in FIG. 5B, due to being elastically deformed until the distance between central winding axes is substantially 0 when the starting wire 7 is fitted to the arc tube 5.

In this way, before being fitted to the arc tube 5, the wire is subject to a bending procedure to form the wire into shape that conforms to the external shape of the arc tube 5, and the bent starter wire 7 is fitted to the arc tube 5 when it becomes necessary to assemble the two. This means that opportunities for the starting wire 7 to become deformed are minimal.

Accordingly, the possibility that the part of the starting wire 7 that passes through the aperture 8*b* of the plate will deviate from the intended routing path decreases, and the insulation distance (rd) can be easily ensured.

Furthermore, compared to conventional manufacturing methods of winding a wire around the center of the arc tube 5 or implementing a bending process, the manufacturing method of the present invention improves work efficiency and reduces manufacturing costs.

As has been described, according to the present embodiment, even if the vessel, in other words the main tube part 5*a*, of the arc tube 5 of the metal halide lamp breaks, current is kept to a level at which the arc discharge, specifically abnormal discharge, does not occur across the electrode 14 and the starting wire 7. This prevents over-current, and therefore prevents secondary damage to components such as the ballast and the outer tube 2.

Note that the metal halide lamp 20 in the present embodiment is not limited to having the described power rating of 150 W, but may have any power rating in a range of 50 W to 400 W.

In this range, it is necessary for the current restricting element 6 to have a resistance value in a range of 1 kΩ to 1 MΩ, in order to prevent abnormal discharge and maintain startup performance at a practical level.

Furthermore, the circuit breaking element 6 is not limited to being the described carbon film resistor, but may be another type of resistor such as a chip resistor.

Furthermore, instead of alternating current, the current applied to the metal halide lamp 20 of the present invention may be direct current.

Furthermore, in the case of alternating current, a capacitor may be used instead of the carbon film resistor used for the circuit breaking element 6.

In other words, with alternating current, a capacitor has impedance in the same way as a resistor, and is therefore able to restrict the value of the current that flows through the starting wire 7, in the same way as a resistor, when the main tube part 5*a* breaks.

Furthermore, it is not necessary for the starting wire 7 to be positioned so as to contact the external periphery of the arc tube 5. Instead, it is sufficient for the starting wire 7 to be in a proximity of the arc tube 5.

Furthermore, the structure of the electrodes and the feeders is not limited to that described. An example of an alternative structure is one in which each pair of an electrode and a feeder is one single member.

Furthermore, although a metal halide lamp is described as an example in the embodiment of the present invention, the present invention can be applied in the same way to a high pressure discharge lamp that has a starting wire positioned in the vicinity of an arc tube. The same effects as the described embodiment can be achieved when the techniques of the present invention are applied, for example, to a mercury lamp or a high pressure sodium lamp.

Furthermore, the material used for the starting wire 7 is not limited to being the described molybdenum (Mo) with a diameter of 0.2 mm. The material may be a material (including an alloy) that includes any one of the following elements: molybdenum (Mo), tungsten (W), niobium (Nb), and iron (Fe). The diameter of the material may be set to ensure appropriate electric resistance and mechanical and thermal strength.

In the first embodiment, the plate 8, as shown in FIG. 1B is provided with an aperture 8*b* through which the starting wire 7 passes, and the diameter of the aperture 8*b* is such that the plate 8 and the starting wire 7 have the described insulation distance (rd) therebetween. However, this is one example of insulation between the plate 8 and the starting wire 7, and other structures that provide the same type of insulation may be used.

Figure 7:
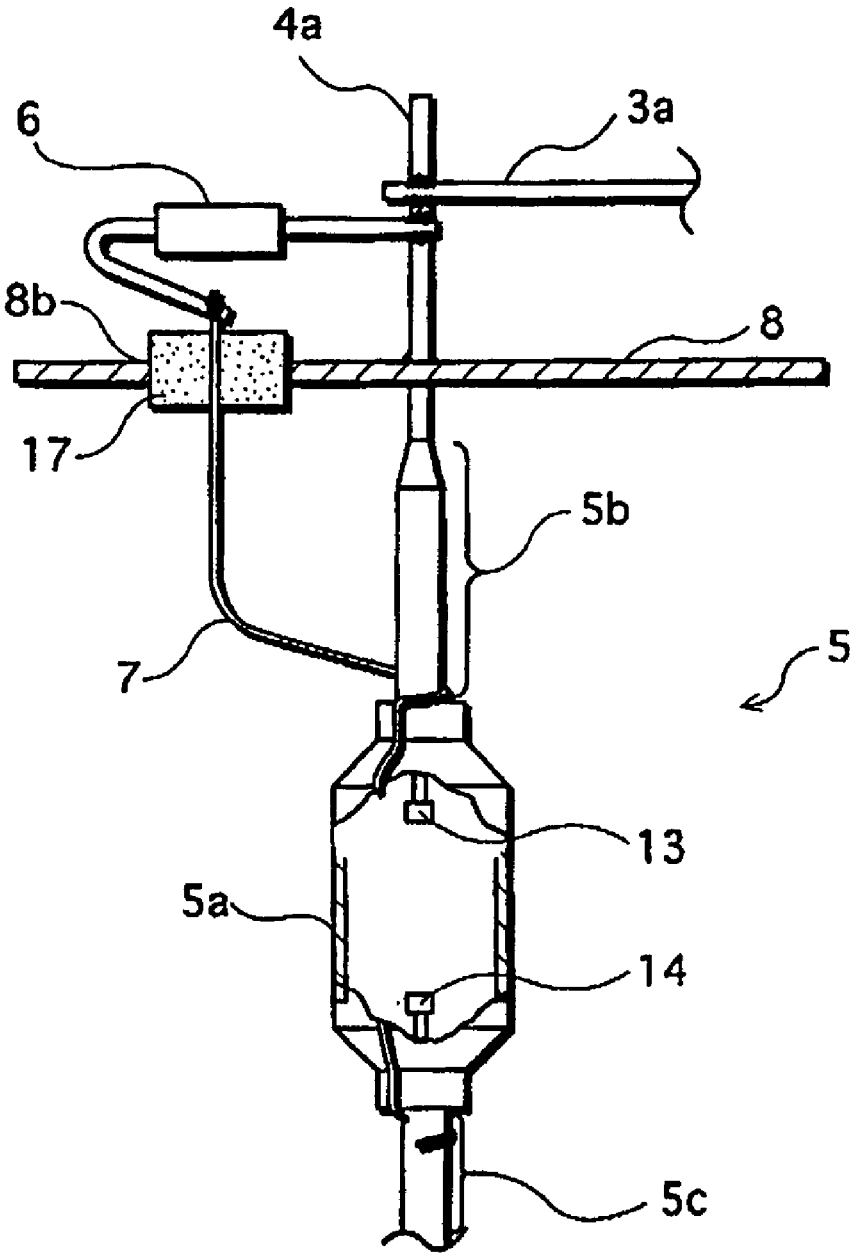
FIG. 7 is a detailed drawing showing routing of the starting wire in the first embodiment of the present invention.

For example, as shown in FIG. 7, insulation 17 may be applied to the aperture 8*b* of the plate 8, and the starting wire 7 passed through the insulation 17, thereby ensuring the insulation distance between the plate 8 and the starting wire 7. Therefore, discharge does not occur across the starting wire 7 and the plate 8, and the circuit breaking element 6 functions to restrict current to a value less than that required for arc discharge.

Second Embodiment

Similar to the metal halide lamp of the first embodiment, the metal halide lamp of the second embodiment is a high pressure discharge lamp in which over-current does not flow, even when the main tube part breaks, and secondary damage to the ballast, the outer tube 2, and so on, is prevented.

Figure 8B:
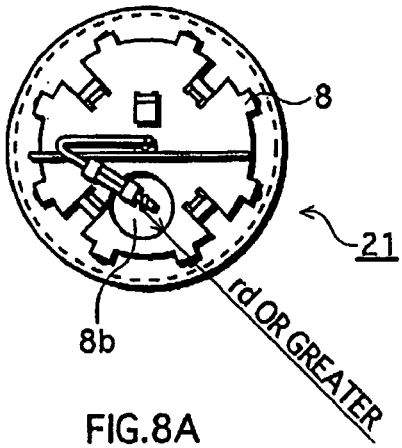
FIGS. 8A and 8B are schematic drawings of a metal halide lamp of a second embodiment.
Figure 8A:
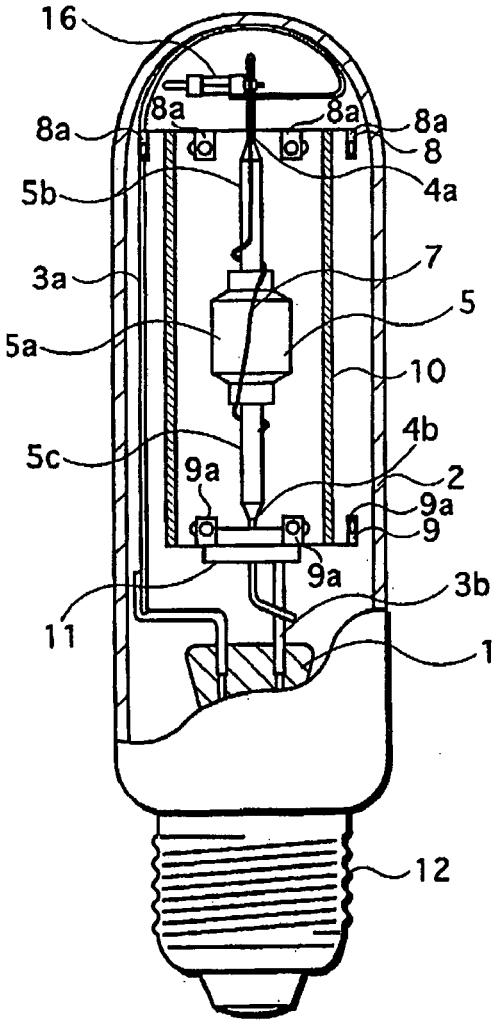

FIGS. 8A and 8B are schematic diagrams of a metal halide lamp 21 of the second embodiment of the present invention.

The metal halide lamp 21 is a high intensity discharge lamp that has a power rating of 150 W. As shown in FIG. 8A, the metal halide lamp 21 has the stem 1, the outer tube 2, the stem wires 3*a* and 3*b*, the feeders 4*a* and 4*b*, the light emitting tube 5, a circuit breaking element 16, the starter wire 7, the plate 8, the plate 9, the sleeve 10, the insulation 11, and the base 12.

The majority of these members are the same as those used in the metal halide lamp 20 of the first embodiment. The members that are different in the metal halide lamp 21 of the second embodiment are the circuit breaking element 16 and the plate 8 which replace the circuit breaking element 6 and the plate 8 of the first embodiment.

The following describes the current breaker 16 and the plate 8.

The plate 8 is a thin stainless steel plate that supports the sleeve 10 so that there is a set gap between the sleeve 10 and the arc tube 5.

Furthermore, the feeder 4*a* passes through the plate 8, and the plate 8 has a plurality of claw parts 8*a* on the outer periphery that contact the outer tube 2.

Furthermore, an aperture 8*b* through which the starting wire 7 passes is provided in the plate 8, as shown in FIG. 8B.

The circuit breaking element 16 is a fuse that has a current potential of 0.5 A, and is welded at one end to the feeder 4*a* and at the other end to the starting wire 7.

The circuit breaking element 16 is capped at either end by cap terminals between which a gap (L) of 4.5 mm is provided, for the following reasons.

Specifically, when insulation between the starting wire 7 and the electrode 14 breaks, abnormal discharge (described later) starts across the starting wire 7 and the electrode 14, a high current flows through the circuit breaking element 16, and the fuse blows. Therefore, the current that flows through the fuse is cut, and, in some cases, this causes abnormal discharge across the caps of the circuit breaking element 16 and across the starting wire 7 and the electrode 14.

Consequently, in order to prevent at least the abnormal discharge across the caps, in other words, in order to prevent insulation breakage between the caps, it is necessary to ensure a set insulation distance (rd) between the cap terminals.

As a result of experimenting, the inventors found that an insulation distance (rd) of 4.5 mm is appropriate in metal halide lamps having a power rating in a range of 50 W to 400 W, including the metal halide lamp 21 (power rating 150 W).

Furthermore, as in the first embodiment, an aperture of 8*b* through which the starting wire 7 passes is provided in the plate 8. In order to prevent insulation breakage between the part of the starting wire 7 that passes through the aperture 8*a* and the plate 8 after the fuse has blown, the diameter of this aperture is such that the insulation distance from the starting wire is at least the described insulation distance (rd), in other words, at least 4.5 mm.

The metal halide lamp 21 is driven by a driving circuit that is provided separately and that includes a power circuit (not illustrated) for supplying power, a ballast (not illustrated) for adjusting current, and an igniter (not illustrated) for applying a high voltage pulse during startup.

The function of the power circuit and the igniter are the same as those described in the first embodiment.

<Operations>

Figures 9A, 9B:
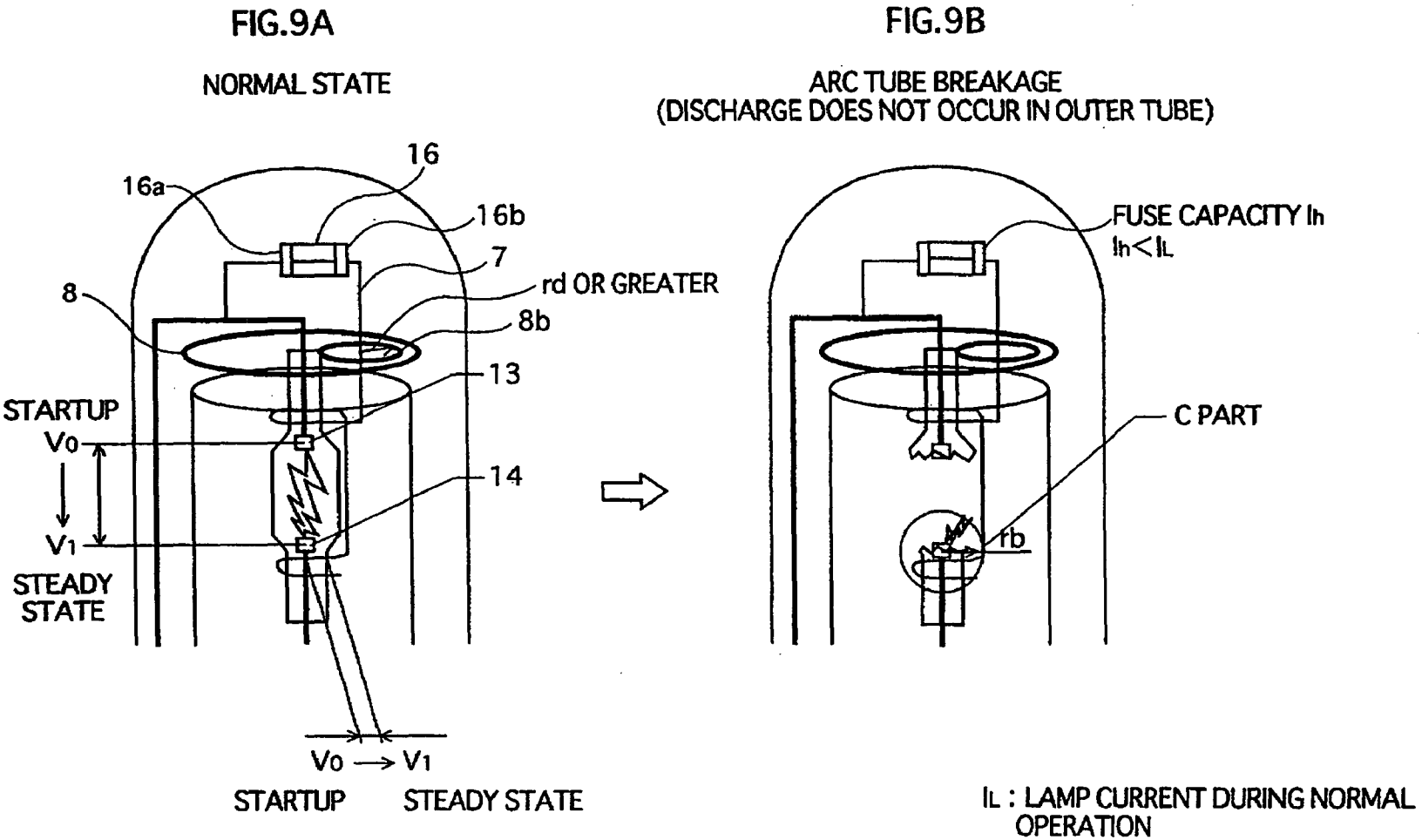
FIGS. 9A and 9B is a type drawing of operation states of the metal halide lamp of the second embodiment of the present invention.
Figure 10B:
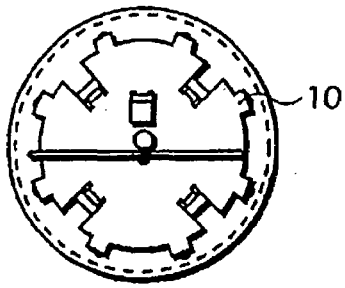
PRIOR ART FIG.10B
FIGS. 10A and 10B are schematic drawings of a conventional metal halide lamp.
Figure 10A:
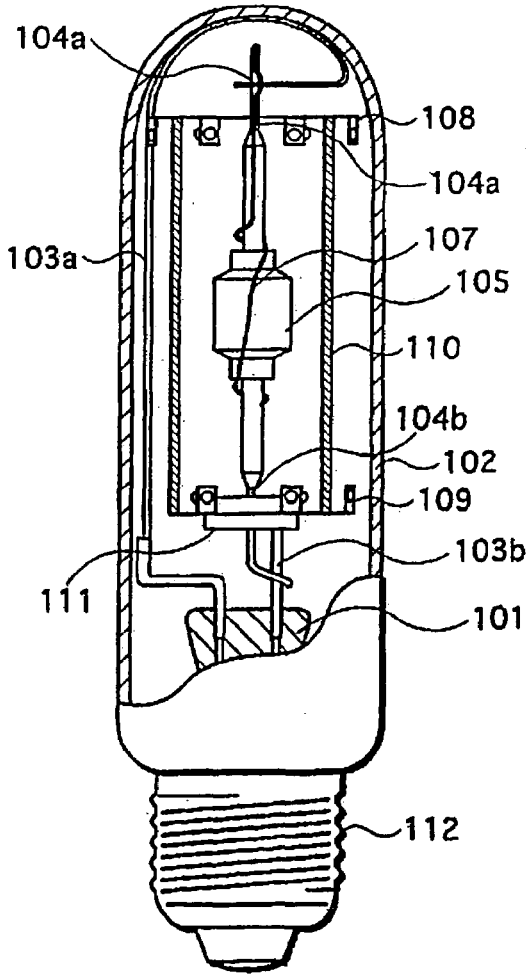
PRIOR ART FIG.10A

FIG. 9A shows the state of the metal halide lamp 21 during normal operation. The state here is the same as for the metal halide lamp 20 in the first embodiment.

<Breakage of the Main Tube Part 5*a*>

The following describes breakage of the main tube part 5*a*.

FIG. 9B shows the state of operation of the metal halide lamp 21 when the main tube part 5*a* breaks.

As described earlier, during operation the main tube part 5*a* becomes a small pressure vessel that is subject internally to high temperature and high pressure, and may break due to cracks and the like caused by heat fatigue.

When breakage occurs, the metal halide, mercury, and rare gas such as neon or argon, leak from the arc tube 5 to the outer tube 2.

Subsequently, when the main tube part 5*a* that acts as insulation between the neighboring parts of the starting wire 7 and the electrode 14 is damaged and falls away, the starting wire 7 and the electrode 14, between which there is an electric potential difference, are exposed to each other.

Here, arc discharge across the electrodes 13 and 14 ceases due to the breakage of the main tube part 5*a*, and the lamp voltage rises. The igniter detects the increase in lamp voltage, and adds a high voltage pulse ($+V_0$, $-V_0$) to the sine wave voltage.

As a result, destruction of insulation occurs between the electrode 14 and the part of the starting wire 7 that is closest to the electrode 14, specifically the C part, and arc discharge occurs.

In this case, vapor pressure in the outer tube, which is the discharge space, is low, and the lamp voltage decreases. Therefore, generally, the lamp current becomes higher than during normal operation.

Here, if the lamp current during normal operation is $I_L$, by setting the current capacity $I_H$ of the circuit breaking element 16 lower than $I_L$, the current path to the starting wire 7 is cut when the arc discharge occurs across the C part of the starting wire 7 and the electrode 14, and therefore arc discharge, in other words abnormal discharge, is stopped.

In this way, according to the present embodiment, even when the vessel of the arc tube 5, in other words the main tube part 5*a*, breaks, and when arch discharge, in other words abnormal discharge, occurs across the electrode 14 and the starting wire 7, the current path is cut, and over-current does not flow. Therefore, secondary damage to the ballast, the outer tube 2, and the like is prevented.

Note that the metal halide lamp 21 in the present embodiment is not limited to having the described power rating of 150 W, but may have any power rating within a range of 50 W to 400 W.

Furthermore, the current capacity of the circuit breaking element 15 is not limited to being 0.5 A as described in the present embodiment. If the lamp current during normal operation is $I_L$, it is sufficient for the current capacity $I_H$ to be less than $I_L$.

Instead of alternating current, the current applied to the metal halide lamp 21 of the present invention may be direct current.

Furthermore, it is not necessary for the starting wire 7 to be positioned so as to contact the external periphery of the arc tube 5. Instead, it is sufficient for the starting wire 7 to be in a proximity of the arc tube 5.

Figures 11A, 11B, 11C:
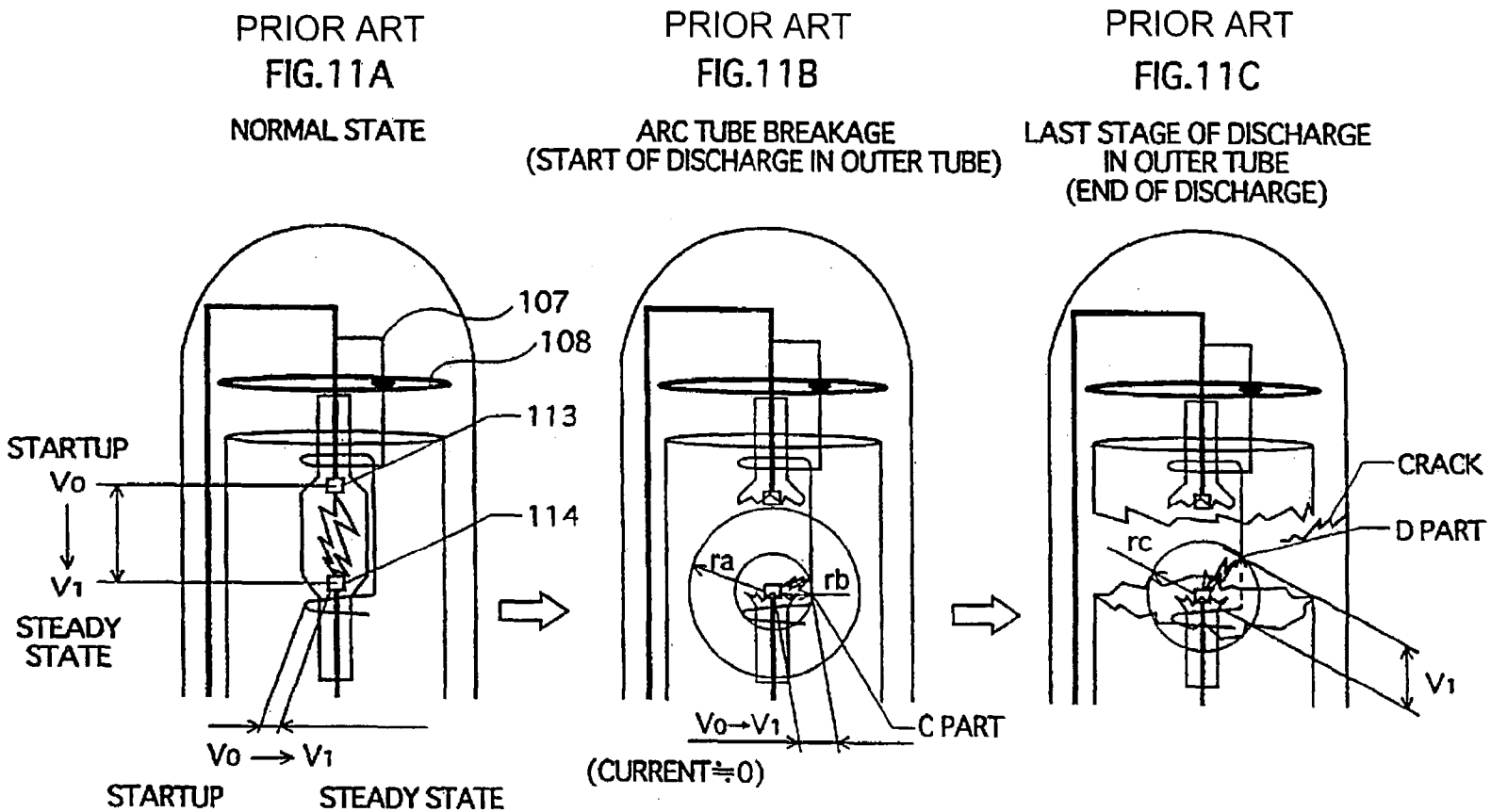
PRIOR ART FIG.11A
PRIOR ART FIG.11B
PRIOR ART FIG.11C
FIGS. 11A to 11C are drawings for explaining states of a conventional metal halide lamp during normal operation and when the main tube part breaks.

Furthermore, by focusing on the fact that with the conventional starting wire 107 shown in FIG. 11C several minutes are required for the discharge distance ($r_c$) of abnormal discharge to grow to the D part, and that during that time over-current flows through the ballast, temperature in the outer tube 2 increases, and secondary damage occurs, the inventors discovered that if the abnormal discharge occurs for less than 10 seconds, the ballast does not exhibit functional damage, and the outer tube 2 is not broken.

For this reason, when arc discharge occurs across the 5 starting wire 7 and the electrode 14, the starting wire 7 may be intentionally made to melt, in other words, to have melting of the starting wire progress to the D part in FIG. 11C within 10 seconds, thereby ending abnormal discharge.

In other words, it is not necessary to provide the circuit breaking element 16 and the starting wire 7 as independent components. Instead, the structure may be simplified by including the function of the circuit breaking element 16 in the starting wire 7.

In this case, the extent to which the starting wire 7 melts can be adjusted according to the material and the wire diameter used for the starter wire 7.

Furthermore, the starting wire 7 is not limited to being molybdenum wire with a 0.2 mm diameter as described in the present embodiment. In particular, when the starting wire 7 is used as the circuit breaking element 16, it is sufficient to select a conductive material and a wire diameter that exhibit the necessary characteristics for breaking the circuit by melting.

Furthermore, the structure of the electrodes and the feeders is not limited to that described. An example of an alternative structure is one in which each pair of an electrode and a feeder is one single member.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. A metal halide lamp, comprising:

a ceramic arc tube that is composed of a main body and two narrow tube parts provided at respective ends of the main body;

a pair of electrodes provided inside the main body;

two feeders, each being connected at one end thereof to a different one of the electrodes inside the main body, and extending through a different one of the narrow tube parts, so as to be external to the arc tube at another end;

a starting wire that is connected to one of the feeders, and that is in a vicinity of or contacts an outer surface of the arc tube; and a current-limiting unit, that is on a current path of the starting wire, limits current on the current path during an abnormal discharge between one of the electrodes and the starting wire during operation of the lamp.

2. The metal halide lamp claim 1, wherein the current-limiting unit is a capacitor.

3. The metal halide lamp of claim 1, further comprising:

a sleeve that encloses the arc tube; and a supporting part that supports the sleeve at at least one end of the sleeve, and is conductive, wherein the starting wire passes trough the supporting part in a state of insulation from the supporting part.

4. The metal halide lamp of claim 3, wherein the starting wire passes through insulation provided on the supporting part, the insulation lying between the starting wire and the supporting part.

5. The metal halide lamp of claim 4, wherein a slant distance between starting wire and one of the electrodes that is not the electrode connected to the starting wire via the one of the feeders, is shorter than a distance between the electrodes.

6. The metal halide lamp of claim 1, wherein the current-limiting unit is a resistor.

7. The metal halide lamp of claim 6, wherein a resistance value of the resistor is in a range of 1 kΩ to 1 MΩ, inclusive.

8. The metal halide lamp of claim 7, having a power rating in a range of 50 W to 400 W, inclusive, wherein two terminals that each connect to a power supply path are provided at two different positions on the resistor, a distance between the terminals being at least 4.5 mm.

9. The metal halide lamp of claim 8, wherein the arc tube is accommodated in an outer tube, a sleeve that encloses at least the main body is provided between the outer tube and the arc tube, a first supporting part and a second supporting part are provided at respective ends of the sleeve in order to hold the sleeve, and the resistor is provided in the outer tube, in a space that is outside a space between the first supporting part and second supporting part.

10. The metal halide lamp of claim 9, wherein the first supporting part is joined to the feeder to which the starting wire is connected, and has an aperture through which the starting wire passes, and a minimum distance between the first supporting part and a part of the starting wire that passes through the aperture is at least 4.5 mm.

11. The metal halide lamp of claim 10, wherein one end of the starting wire is wound around a part of the arc tube that is resistant to deformation if to arc tube breaks.

12. A metal halide lamp comprising:

a ceramic arc tube that is composed of a main body and two narrow tube parts provided at respective ends of the main body;

a pair of electrodes provided inside the main body;

two feeders, each being connected at one end thereof to a different one of the electrodes inside the main body, end extending through a different one of the narrow tube parts, so as to be external to the arc tube at another end;

a starting wire that is connected to one of the feeders, and that is in a vicinity of or contacts an outer surface of the art tube; and a current-limiting unit, that is on a current path of the starting wire, cuts current to the starting wire within a predetermined amount of time of an occurrence of an outer tube discharge between the starting wire and one of the pair of electrodes during a post-start up operation of the lamp.

13. The metal halide lamp of claim 12, wherein the predetermined amount of time is 10 seconds.

14. The metal halide lamp of claim 12, wherein the predetermined amount of time is 1 second.

15. The metal halide lamp of claim 14, wherein the current-limiting unit is a fuse whose current capacity is equal to or less than a value of current required for ordinary operation of the metal halide lamp.

16. The metal halide lamp of claim 15, wherein two terminals that connect to a power supply path are provided at two different positions on the current-limiting unit, a distance between the terminals being at least 4.5 mm.

17. The metal halide lamp of claim 16, wherein the fuse is the starting wire.

18. The metal halide lamp of claim 17, wherein when abnormal discharge occurs, the starting wire melts, within the predetermined amount of time, to an extent that a discharge distance is insufficient for abnormal discharge to continue.

19. The metal halide lamp of claim 18, wherein the starting wire is made of a metal selected from the group consisting of molybdenum, tungsten, niobium, and iron, or of an alloy that contains a-metal selected from the group.

20. The metal halide lamp of claim 19, wherein the starting wire is a molybdenum wire that has a diameter of 0.2 mm or less.

21. The metal halide lamp of claim 20, wherein the arc tube is accommodated in an outer tube;

a sleeve that encloses at least the main body is provided between the outer tube and the arc tube, a first supporting part and a second supporting, part are provided at respective ends of the sleeve in order to hold the sleeve, and the current-limiting unit is provided in the outer tube, in a space that is outside a space between the first supporting part and second supporting part.

22. The metal halide lamp of claim 21, wherein the first supporting part is joined to the feeder to which the starting wire is connected, and has an aperture through which the starting wire passes, and a minimum distance between the first supporting part and a part of the starting wire that passes through the aperture is at least 4.5 mm.

23. The metal halide lamp of claim 21, wherein one end of the starting wire is wound around a part of the arc tube that is resistant to deformation if the arc tube breaks.

24. A metal halide lamp, comprising:

an arc tube including a main body;

a pair of electrodes provided inside the main body;

two feeders, each being connected, at a respective end of the main body to be external to the arc tube;

a starting wire that is connected to one of the feeders, and that is in a vicinity of or contacts an outer surface of the arc tube;

a current-limiting unit that is on a current path of the starting wire, and limits current on the current pat;

a sleeve that encloses the arc tube; and a supporting part that supports the sleeve at at least one end of the sleeve, and is conductive, wherein the starting wire passes through the supporting part in a state of insulation from the supporting part.

25. The metal halide lamp of claim 24, wherein the starting wire passes through insulation provided on the supporting part, to insulation lying between the starting wire and the supporting part.

26. The metal halide lamp of claim 24, wherein a slant distance between the starting wire and one of the electrodes that is not the electrode connected to the starting wire via the one of the feeders, is shorter than a distance between the electrodes.

27. A metal halide lamp, comprising:

a ceramic arc tube that is composed of a main body and two narrow tube parts provided at respective ends of the main body;

a pair of electrodes provided inside the main body;

two feeders, each being connected at one end thereof to a different one of the electrodes inside the main body, and extending through a different one of the narrow tube parts, so as to be external to the arc tube at another end;

a starting wire that is connected to one of the feeders, and that is in a vicinity of or contacts an outer surface of the arc tube; and an abnormal discharge current-limiting means for limiting a current carrying capacity of the starting wire, when the arc tube breaks, to a current value restricted within a range in which an operating start up voltage does not rise.

* * * * *